United States Patent [19]

Hohwart

[11] 4,095,657

[45] Jun. 20, 1978

[54] SWIMMING APPARATUS

[76] Inventor: George Hohwart, 2765 Eager Rd., Howell, Mich. 48843

[21] Appl. No.: 621,581

[22] Filed: Oct. 10, 1975

[51] Int. Cl.[2] ..... A63B 31/00

[52] U.S. Cl. ..... 272/71; 35/29 B

[58] Field of Search ..... 272/71, 93, 69, 70, 272/26, 1 R, 109, 32; 35/29 B; 74/240

[56] References Cited

U.S. PATENT DOCUMENTS

| | | | |
|---|---|---|---|
| 656,954 | 8/1900 | Draper | 74/240 |
| 750,920 | 2/1904 | Wagner | 74/240 |
| 1,271,717 | 7/1918 | Kaufmann | 74/240 |
| 1,280,682 | 8/1918 | Dickinson | 74/240 |
| 1,318,796 | 10/1919 | Nortman | 74/240 |
| 1,620,146 | 3/1927 | Walton | 272/71 |
| 2,434,542 | 1/1948 | Borroughs | 272/71 |
| 2,956,541 | 10/1960 | Rall | 35/29 B X |
| 3,512,416 | 5/1970 | Hohwart | 272/71 X |
| 3,721,438 | 3/1973 | Kusmer | 272/71 |
| 3,861,675 | 1/1975 | Hopper | 272/71 |

FOREIGN PATENT DOCUMENTS

| | | | |
|---|---|---|---|
| 1,190,849 | 4/1965 | Germany | 272/71 |
| 2,241,797 | 3/1974 | Germany | 272/71 |

*Primary Examiner*—Jerome Schnall

*Attorney, Agent, or Firm*—Harness, Dickey & Pierce

[57] ABSTRACT

An improvement in the swimming apparatus shown in U.S. Pat. No. 3,512,416 wherein a waistband in the form of a pair of members is fastened around the waist of a swimmer, the outer member being pivotably connected to a slidable telescopic member which is mounted on the side of a pool; associated with the apparatus are a shock absorber to restrain the telescopic movement and an effort meter to register the movement by the swimmer. In the improvement, an endless belt is attached to a support structure extending over the water. The endless belt is attached to an adjustable pulley member on the support structure and adapted to be double-looped around the swimmer's waist. A belt guide is positioned between the pulley member and the swimmer to hold the endless belt in position.

8 Claims, 6 Drawing Figures

SWIMMING APPARATUS

BACKGROUND — SUMMARY OF THE INVENTION

This invention relates to a swimming apparatus adapted to position and hold a swimmer in a confined area in a swimming pool or other body of water and yet allow the swimmer to swim freely and in a relatively unrestricted manner.

U.S. Pat. No. 3,512,416 discloses a swimming apparatus which is mounted on the edge of a swimming pool and which permits the swimmer to swim freely in any position and to move easily from one position to another. The swimmer is held in a rigid, oversized waistband in the form of a pair of relatively rotatable inner and outer members which are adapted to fit around the waist of the swimmer and be securely attached thereto. The outer member is pivotably connected to one of a pair of slidable telescopic members, the other of which is mounted on the side of the pool, and the telescopic members project over the water and hold the rotatable members partially submerged to accommodate a swimmer therein. The telescopic members have a shock absorber attached thereto to restrain them against extensive movement. Further, an effort meter is attached to the telescopic members for registering the amount of effort the swimmer is able to exert in the water.

An object of the present invention is to provide an improved swimming apparatus which has a simpler design and is less expensive to manufacture and construct.

A further object is to provide an improved swimming apparatus which achieves greater comfort for the swimmer.

Basically, the swimming apparatus of the present invention is adapted to be mounted on or alongside the edge of a swimming pool or other body of water and to be detachably fastened to a swimmer. In the case of a pool made of concrete or other strong material, the apparatus can be embedded in or firmly attached in some suitable manner to the pool itself. On the other hand, if the apparatus is to be used with a pool which is made of more flimsy material such as rubber or plastic, it can be mounted on the ground or other suitable supporting surface alongside the pool. A pipe or auger embedded in the ground near the pool will in most cases provide an adequate mounting base for the apparatus. The apparatus permits the swimmer to swim freely and as hard as he wishes with whatever stroke and in whatever position he wishes, and yet be confined to a limited area in the water. The apparatus comprises a main support which, as suggested, is attached to or mounted alongside the pool and an adjustable cantilever arm extending outward therefrom over the water. The outer end of the cantilever arm slopes downwardly toward the surface of the water and contains thereon a slidable and adjustable pulley member. The pulley member has an endless belt attached to it which is adapted to be looped around the waist of the swimmer. A belt guide attached to the end of the cantilever member confines the belt at a point adjacent to the swimmer and it also holds the belt in position during the swimming action while at the same time permitting the portions of the belt extending between the swimmer and the pulley to slide freely back and forth as the belt moves to accommodate the rolling and forward movements of the swimmer. In practice, the belt can be looped around the swimmer either before or after he enters the pool. In either case, the belt should be looped at least once completely around the waist of the swimmer. In general, this is the preferred mode. However, in the case of a slim person or a child, for example, the belt can be looped several times around the waist without seriously or adversely affecting the action of the apparatus in use. Usually, the swimmer loops the endless belt around his waist before entering the water and after he does so, he places the two lengths of belt extending from his waist in the guide and adjusts the pulley on the cantilever member according to his size so that the belt is snug about his waist with little or no slack between his waist and the pulley. Thereafter, the swimmer can swim freely in a confined area of the pool and is held firmly but comfortably by the swimming apparatus.

The present invention is particularly useful in small pools where the distance or space is too limited for exerted swimming. It is also useful as an aid in teaching or training persons to swim and can be used in hospitals and other institutions as an exercise and therapy apparatus.

Other objectives, features and advantages of the present invention will become apparent by the subsequent description and the appended claims, taken in conjunction with the accompanying drawings.

DESCRIPTION OF THE PREFERRED EMBODIMENTS

Figures 1, 2, 3:
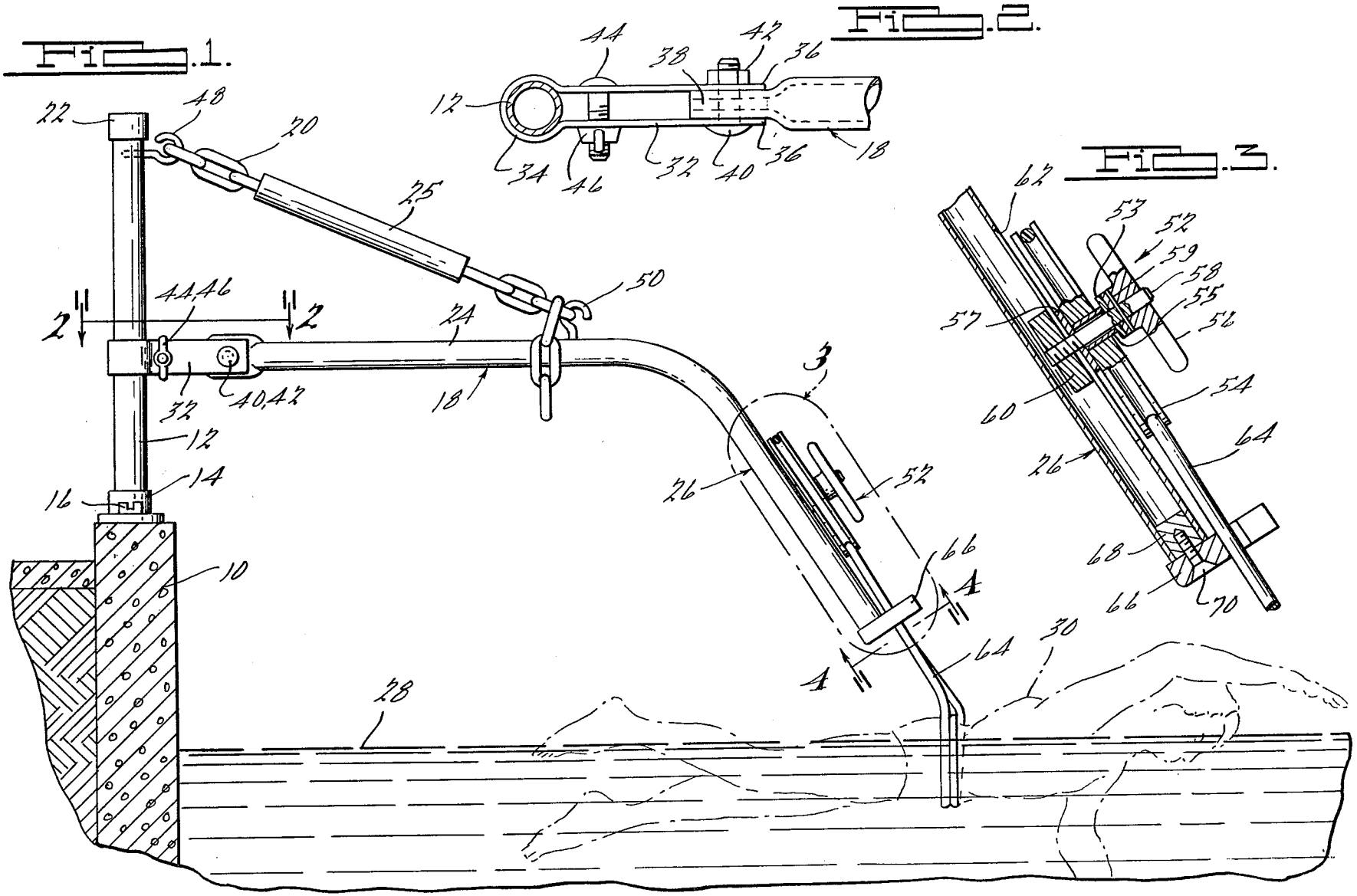
FIG. 1 is a side elevational view of a swimming apparatus illustrating the present invention and showing the same attached directly to the edge of the pool.
FIG. 2 is an enlarged horizontal sectional view taken on the line 2—2 of FIG. 1.
FIG. 3 is an enlarged fragmentary view showing parts in section and parts in elevation of the portion of FIG. 1 enclosed in the circle 3.

Attention is first directed to FIG. 1 which shows a swimming apparatus adapted to be mounted on the side of a swimming pool or other body of water to hold a swimmer in place in a limited area in the water and yet allow him to swim freely therein. While, as suggested, the swimming apparatus can be mounted in any suitable manner either on the pool itself or alongside the pool, it is here shown attached to the side of the swimming pool 10 by a suitable support means having a vertical rod or post member 12. Preferably, the rod member 12 comprises a metal tube or pipe. A cap member 22 is positioned on the top of rod 12 to prevent water and other debris from entering the tube and also to provide a more pleasing and finished appearance.

The rod 12 is here shown attached to the side of the swimming pool 10 by being placed in and firmly attached to a mounting means here shown in the form of a socket 14 which in turn is mounted on and permanently attached by means of bolts or screws 16 to the side wall of the swimming pool 10.

The support means also has a cantilever member or swimming arm 18 and a chain supporting member 20 which are attached to the rod member 12, and the latter is of sufficient length to provide appropriate space for placement thereon of the cantilever member 18 and chain supporting member 20.

The cantilever member 18 comprises two sections, a substantially horizontal section 24 and an angled section 26 which is bent from the horizontal and angled toward the level of the water 28 in the pool 10. The horizontal portion 24 of the cantilever member 18 is sufficiently long so that a swimmer (designated generally by the numeral 30) will be positioned in the swimming apparatus at a satisfactory and safe distance from the edge of the pool 10.

The cantilever member 18 is movable vertically and rotatably on the rod 12 in order to facilitate different sizes, heights, and experience levels of swimmers 30. The member 18 can be attached to the rod 12 in any conventional manner which would accomplish this, but preferably is attached as shown in FIGS. 1 and 2. A clevis 32 is provided with the middle cylindrical portion 34 around the rod 12 and the ends 36 thereof arranged in embracing relation with and attached to a flattened end 38 of the cantilever member 18. The clevis 32 preferably is made of a suitably strong, resilient material, such as plastic or the like, so that it yields somewhat under the force of the swimming strokes and thus takes some of the strain off the post 12 and its mounting 14. Also, a soft plastic material helps preserve the finish of the rod 12 under the working in use and repeated adjustment of the cantilever 18. The flattened portion 38 is positioned between the ends 36 of the clevis 32 and attached thereto by any conventional fastener means, such as the bolt 40 and nut 42 shown in FIG. 2. If the clevis 32 and cantilever 18 are joined together with only one bolt 40, the cantilever 18 can be pivoted on the bolt 40 to raise or lower the angled portion 26 thereof to adjust the latter properly with respect to the surface of the water 28. The chain supporting member 20 also can be adjusted as to length to hold and support the member 18 in any selected angularly adjusted position. It also is possible to secure members 32 and 18 together as shown with a plurality of fasteners to make the joint rigid and non-pivotal.

The cantilever member 18 also can be moved vertically along the rod 12 as a further means of vertical adjustment. For this purpose, a bolt 44 fastened by a wing nut 46 is provided on the bracket 32. When the wing nut 46 is fastened tightly on the bolt 44, the bracket 32 is immobily clamped on the rod member 12. When the wing nut 46 is loosened, however, the bracket 32 can be easily moved upwardly or downwardly and thus placed at any desired position on the rod member 12. When the nut 46 is loosened, it is also possible to swing the member 18 horizontally on the rod 12. This allows the swimming apparatus to be placed at any position within a half-circle area in the pool 10. Moreover, if the swimming apparatus were placed on a stationary support in the middle of a relatively large pool or body of water, it would be possible to position the swimmer at any position within a full-circle area.

As suggested, the support member 20 preferably is in the form of a chain and the latter is attached to the rod 12 and to the cantilever member 18 by hook means 48 and 50, respectively. The hooks 48 and 50 (together with the chain links) provide easily accessible and changeable support positions for angular adjustment of the cantilever member 18 on the rod member 12. It is understood that the supporting member 20 can be any other conventional means provided with a plurality of apertures, slots, or the like, so that it can be attached at various places, either to the rod 12 or to the cantilever 18.

Since the effort of the swimmer 30 is normally in the direction tending to bend or pull down the cantilever member 18 relative to the rod member 12, a shock absorber 25 or other resilient member can, as an optional feature, be incorporated in the supporting member 20 in order to absorb or resist some of the bending or torquing effort produced by the swimmer 30. The shock absorber or other resilient member 25 (as shown in FIG. 1) allows the cantilever member 18 to flex or deflect at least to some limited extent without damage to or adverse effects on the rod 12. The shock absorber also yieldably resists each stroke by the swimmer 30 and thus serves to dampen the effort exerted during the stroke. It also provides a smoother and more controlled swimming action.

Attached to the angled portion 26 of the cantilever member 18 is a pulley assembly which is designated generally by numeral 52 in FIG. 1. The pulley member itself is shown in more detail in FIG. 3.

As shown in FIG. 3, the pulley assembly comprises pulley 54, spacer 55, screw lock handle 56, screw post member 58, washers 53 and 57, and clamping bracket 60. The screw lock handle 56 is non-rotatably attached to the post member 58 by pin 59 or any other conventional means. The post member 58 passes through the center of pulley 54 and is fixedly screwed into clamping bracket 60. The bracket 60 is positioned inside the tubular cantilever portion 26 and acts to hold the pulley assembly thereon. For this purpose, a slot 62 is provided on one side of the cantilever portion 26. The slot 62 also allows the pulley assembly 52 to be adjustably moved along portion 26 and thus be placed at any position along the length of the slot 62. For this purpose, the screw lock handle 56 in cooperation with the post member 58 and the clamping bracket 60 allow the pulley member 52 to be securely positioned anywhere along the slot 62. Washers 53 and 57, together with spacer member 55 which optionally may consist of a bushing or ball bearing assembly, allow pulley 54 to rotate even when the handle 56 is tightened snugly to the clamp bracket 60.

Positioned around the pulley 54 is an endless belt 64. The endless belt 64 is provided of sufficient length to be positioned once around the pulley 54, threaded through or placed in the guide previously referred to and hereinafter described in detail, and then looped at least once around the waist of the swimmer 30. The belt 64 can be of any conventional type, such as a rope, or a rubber or plastic member, but preferably is made of a material which will not stretch or be otherwise adversely affected by being constantly immersed in water. Also, the belt 64 should be relatively smooth and soft so that it will not injure, irritate, or otherwise adversely affect the swimmer 30. As stated above, the pulley 54 is free to rotate at all times in order to accommodate movement of the endless belt 64.

Figures 4, 5, 6:
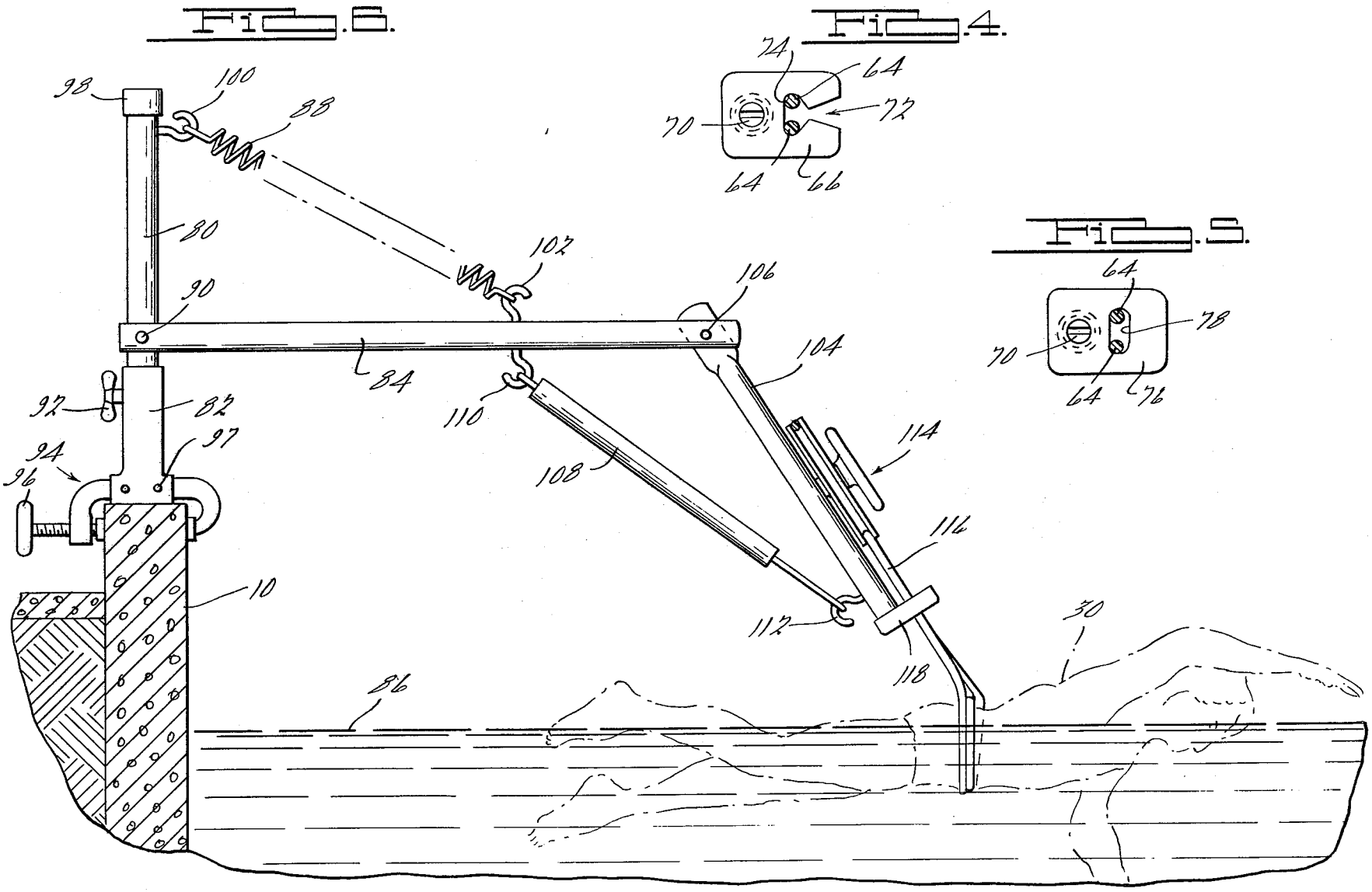
FIG. 4 is a transverse sectional view taken on the line 4—4 in FIG. 1 and showing a preferred form of belt guide.
FIG. 5 is a view similar to FIG. 4 but showing a modified form of belt guide.
FIG. 6 is a side elevational view showing a modified form of swimming apparatus embodying the present invention which is adapted to be detachably fastened to the edge of the swimming pool.

A belt guide 66 is attached to the end of the cantilever member 18. An enlarged elevational view of the belt guide 66 is shown in FIG. 4. The belt guide 66 is attached in any conventional manner to the end of the cantilever member 18. This can be accomplished by use of a plug member 68 securely positioned in and affixed to the end of the member 18 and a screw means 70 which is positioned through the belt guide and securely anchored in the plug member 68.

The guide 66 has a slot 74 therein for positioning and containing the belt 64. A channel or way 72 preferably is provided communicating with the slot 74 so that the endless belt 64 can be easily inserted into and removed from the belt guide 66. The guide 66 insures that the belt 64 is securely held in place around the waist of the swimmer 30 and also on the pulley assembly 52.

Another embodiment of the belt guide is shown in FIG. 5 and designated by numeral 76. The belt guide 76 is similar in structure and operation to the belt guide 66 except that it does not have a channel 72 therein. Thus, with this embodiment of the invention, the endless belt 64 must be threaded through the slot 78 before being placed on the pulley 54.

When the swimming apparatus is used, the swimmer 30 steps into the water preferably with the belt 64 already looped around his waist. All he has to do then is to place the belt 64 in the guide 66 and the far end of the belt around the pulley 54. Alternatively, of course, he can leave the belt 64 on the swimming apparatus. In this event, the swimmer must remove the belt from the apparatus by releasing it from the pulley 52 and pulling it out of the guide 66. He then forms a loop in the belt and steps into the loop he has formed, pulls the two ends of the belt slightly so that the loop is relatively snug around his waist. Then, he positions the belt 64 in the belt guide 66 and around the pulley 54. The pulley assembly 52 is then adjusted by means of the screw lock handle 56 until the endless belt 64 is relatively tight throughout its length. The swimming apparatus is then set for the swimmer and the swimmer can lie down in the water and perform any swimming stroke that he desires. The structure and position of the swimming apparatus permit the swimmer 30 to swim without any interference from any portion thereof. In fact, for the most part, the swimmer 30 is able to swim as naturally as if he were free of the apparatus. If the swimmer 30 desires to change from one stroke to another, such as the crawl stroke to a side stroke, he simply rolls slightly in the double loops around his waist and the belt 64 and pulley 52 rotate and move accordingly to accommodate for the movement and change of position. Similarly, if the swimmer wishes to swim on his back, he simply rolls 180° and once again the endless belt 64 and pulley member 52 accommodate for this movement.

The swimming apparatus also permits the swimmer 30 to dive under the surface of the water 28 and to swim beneath it or conversely to swim from a submerged position to the surface of the water 28.

For the preferred use of the swimming apparatus, the level of the water 28 should be approximately at the swimmer's waist when the endless belt 64 is positioned around it. To provide for this (depending on the size and height of the swimmer 30), the cantilever member 18 is adjusted, as described above, along the rod 12. If desired, the member 18 also can be pivoted relative to bracket 32 in order to accurately position the member 18. The cantilever member 18 is positioned generally so that the belt 64 when formed as a double loop will be positioned approximately at the level of the water 28. After the swimmer 30 positions himself in the belt 64, the pulley assembly 52 is then adjusted to pull the belt 64 snugly around him.

Another embodiment of the swimming apparatus in accordance with the present invention is shown in FIG. 6. In this embodiment, the swimming apparatus is connected to the swimming pool 10 so that it can be quickly and easily removed therefrom. A pair of telescoping members 80 and 82 are provided to extend vertically from the swimming pool 10. The telescoping members 80 and 82 are attached to a cantilever member 84 which is positioned approximately horizontally over the water 86.

The horizontal cantilever member 84 is securely fastened to the upper telescoping member 80 by means of a pin 90 or any other conventional means. The members 80 and 82 are telescoping so that they can be moved upwardly or downwardly relative to each other to adjust the position of the cantilever member 84 relative to the level of the water 86; this is similar to the manner in which the cantilever member 18 is adjusted along the rod 12 in the embodiment shown in FIG. 1. Although the upper member 80 is indicated as being positioned inside lower member 82, it is understood that telescoping members 80 and 82 can be provided to function in the opposite manner, that is, that the lower member 82 can be positioned inside the upper member 80. A set screw or wing nut 92 is provided on the lower telescoping member 82 to releasably hold the upper telescoping member 80 in position. In this manner, the member 80 can be positioned vertically within the lower member 82 and also can be rotated so that the cantilever member 84 can be positioned over the level of the water 86 at any angle to the side of the pool 10.

The member 82 is attached to the swimming pool 10 by a removable clamping assembly 94. In the embodiment shown, the clamping assembly 94 comprises a C-clamp. The C-clamp is attached to the side wall of the pool 10 and by means of the screw lock 96 is firmly secured thereon. The clamping assembly 94 is also attached to the telescoping member 82. This can be accomplished by pins 97, or any other conventional fastening means.

Similar to the rod 12, the upper telescoping member 80 is a tubular pipe member and has an appropriate cap 98 thereon. Also, a supporting member 88 is positioned between the vertically extending member 80 and the horizontally extending cantilever member 84. The member 88 is attached to the members 80 and 84 by means of hooks 100 and 102 respectively. As shown in FIG. 6, the supporting member 88 is comprised of a coil spring so that it will have some resiliency and absorbing effect for the effort produced by the swimmer 30 in the water. It is also possible, of course, to have the supporting member 88 be a chain link member similar to that shown in FIG. 1, and also to have a shock absorber positioned therein (not shown).

Attached to the cantilever member 84 is another tubular member 104 which is positioned at an angle downwardly toward the level of the water 86. A pivotable hinge or pin means 106 is provided to securely attach the members 84 and 104 together and at the same time to allow 104 to rotate relative to the member 84. A resilient supporting member 108 is provided between the members 84 and 104 and is attached thereto by hooks 110 and 112. The member 108 can be a coil spring, chain, shock absorber, or any other resilient member as described above. Preferably, member 108 is a shock absorber and is positioned as to resist the swimming stroke of the swimmer 30 and thus to dampen the peak effort exerted thereby.

The tubular member 104 has a pulley assembly 114 positioned thereon which is similar in structure and operation to the pulley assembly 52 described above. The pulley assembly 114 is positioned in a slot provided in member 104 and functions in the same manner described above. An endless belt 64 is provided between the pulley assembly 114 and the swimmer 30. A belt guide 118 is positioned on and attached to the lower end of the tubular member 104. The belt guide 118 is similar to either of the belt guides 66 or 76 described above and operates in the same manner.

The embodiment of the swimming apparatus shown in FIG. 6 is utilized in the same manner as the swimming apparatus shown in FIG. 1. A swimmer 30 first positions the height of the cantilever member 84 above the level of the water 86. He then enters the water, preferably with the belt 64 looped about his waist in the manner hereinabove described, gathers the left-over length of belt and places it in the guide 66, loops the far end of the belt around the pulley 54, and adjusts the pulley assembly 114 longitudinally on the member 104 to draw the belt 64 snugly between him and the swimming apparatus. The swimmer 30 can then swim and orient himself freely (as described above with reference to FIG. 1).

If desired, the cantilever members 18 and 84 can consist of a pair of telescoping members similar to those described in U.S. Pat. No. 3,512,416. Also, an effort meter similar to the effort meter shown in U.S. Pat. No. 3,512,416 can be provided for use in conjunction with the swimming apparatus of the present invention. The effort meter would allow the swimmer 30 to determine the effort that he was using to swim in the water, and also would allow him to exert a sustained swimming effort.

Although the invention has been described with respect to certain embodiments, it is understood that numerous modifications and changes may occur to those skilled in the art and that any such modifications and changes are included within the scope of the invention as defined by the following claims.

I claim:

1. A swimming apparatus for holding and supporting a swimmer in a pool of water while at the same time allowing the swimmer to swim naturally, to change from one swimming position to another, and to roll and twist during swimming, the apparatus comprising support means adapted to be attached to a stationary mounting means adjacent to said pool and having a cantilever member extending laterally over said pool and terminating at the outer end thereof at a position adjacent the swimmer;

a belt support member having a first end portion secured to said cantilever member intermediate the end thereof, and a second free end portion projecting outwardly from said cantilever member; means mounted on said second end portion of said belt support member and having the periphery thereof exposed, said periphery defining a belt engaging surface facing away from said outer end of said cantilever member;

an endless, rope-like belt means having a portion thereof looped over said support member and engaged with said surface, said belt means also including a portion extending from said support member which is of sufficient length to be wrapped at least once around the swimmer's waist when the latter is in swimming position in said pool, said belt means being operative to travel back and forth around the support member and about the swimmer as the latter rolls and turns in swimming or moves from one swimming position to another;

guide means on said cantilever member outboard of said support member and located between said support member and the portion of said belt means wrapped around the swimmer for slidably receiving portions of said endless belt means between said support member and the swimmer and operative to gather and confine the same to prevent said belt means from slipping along the body of the swimmer while permitting said confined portions to slide back and forth therein as the belt means moves on the support member and around the swimmer in response to the swimmer's movements; and means for adjusting the position of said support member along said cantilever member to provide compensation for variable conditions such as water level and swimmer size.

2. The swimming apparatus defined by claim 1 wherein said support member operatively supports a rotatable pulley, and wherein said pulley defines said surface.

3. The swimming apparatus defined by claim 2 wherein the portion of said cantilever member that carries said pulley and said guide means is disposed obliquely to the surface of the water in the pool, and wherein said support means is resiliently yieldable to accommodate movement of said swimmer.

4. The swimming apparatus defined by claim 2 wherein both said pulley and said guide means are disposed above said cantilever member, and said guide means having an upwardly opening way through which said belt means can be passed.

5. The swimming apparatus defined in claim 2 wherein said pulley and said guide means are mounted on the outer terminal portion of said cantilever member, and wherein the outer terminal portion of said cantilever member is disposed obliquely with respect to the surface of the water in the pool.

6. The swimming apparatus defined in claim 2 wherein said pulley and said guide means are mounted on the outer terminal portion of said cantilever member, wherein the outer terminal portion of said cantilever member is disposed obliquely with respect to the surface of the water in the pool, and wherein said cantilever member is adjustable vertically relative to said stationary mounting means to regulate the length of said belt means extending from the guide means and available to be looped around the swimmer's waist.

7. The swimming apparatus defined by claim 1 wherein said support means includes a vertical post which carries said cantilever member, wherein the outer terminal portion of said cantilever member has limited movement in response to the swimmer's motions; said apparatus including means interconnecting said post and said cantilever member for yieldably resisting movement of the latter.

8. The swimming apparatus defined by claim 1 including means interconnecting said cantilever member and said mounting means permitting limited movement of the member in use and including resilient means for yieldably resisting such movement.

* * * * *